US007875122B2

(12) United States Patent
Gonska et al.

(10) Patent No.: US 7,875,122 B2
(45) Date of Patent: Jan. 25, 2011

(54) INDUSTRIAL DISHWASHER AND METHOD OF OPERATING THE SAME

(75) Inventors: Heinrich Gonska, Offenburg (DE); Roland Walz, Hohberg (DE); Harald Disch, Elzach (DE)

(73) Assignee: Premark FEG L.L.C., Wilmington, DE (US)

( * ) Notice: Subject to any disclaimer, the term of this patent is extended or adjusted under 35 U.S.C. 154(b) by 349 days.

(21) Appl. No.: 12/032,754

(22) Filed: Feb. 18, 2008

(65) Prior Publication Data

US 2008/0202557 A1 Aug. 28, 2008

(30) Foreign Application Priority Data

Feb. 22, 2007 (DE) ..... 10 2007 008 826

(51) Int. Cl.
*B08B 7/04* (2006.01)

(52) U.S. Cl. ..... 134/18; 134/25.2

(58) Field of Classification Search ..... 134/18, 134/25.2

See application file for complete search history.

(56) References Cited

U.S. PATENT DOCUMENTS 3,068,877 A 12/1962 Jacobs
3,807,420 A 4/1974 Donselman et al.
4,179,821 A 12/1979 Herbst et al.
2008/0264458 A1 * 10/2008 Berner et al. ..... 134/57 D

FOREIGN PATENT DOCUMENTS

| | | | |
|---|---|---|---|
| DE | 4029958 | | 11/1991 |
| DE | 4029958 | A1 | 11/1991 |
| DE | 102005023428 | | 11/2000 |
| DE | 10-2005-023428 | * | 11/2006 |
| DE | 102005023428 | A1 | 11/2006 |
| EP | 0378836 | | 7/1990 |
| EP | 0378836 | A1 | 7/1990 |
| EP | 0711528 | | 5/1996 |
| EP | 0711528 | A1 | 5/1996 |
| EP | 0978250 | A2 | 8/1999 |
| EP | 0978250 | | 2/2000 |
| WO | WO 2006/123947 | | 11/2006 |

* cited by examiner

*Primary Examiner*—Michael Barr
*Assistant Examiner*—Saeed T Chaudhry
(74) *Attorney, Agent, or Firm*—Thompson Hine LLP

(57) ABSTRACT

Industrial dishwasher and method of operating the same, wherein, during at least one operating state other than the drying phase, program control automatically provides for second ambient air to be blown by means of the additional blower directly into the drying channel and through the latter and out through the blowing-out opening, the dishwasher being switched on but the main blower being switched off.

9 Claims, 5 Drawing Sheets

INDUSTRIAL DISHWASHER AND METHOD OF OPERATING THE SAME

CROSS REFERENCE TO RELATED APPLICATIONS

This application claims the benefit of German Application DE 10 2007 008 826.6, filed Feb. 22, 2007.

TECHNICAL FIELD

The invention relates to an industrial dishwasher and a method of operating the same, the industrial dishwasher being a batch dishwasher.

BACKGROUND

A dishwasher of this type is known from DE 10 2005 023 428 A1. Further dishwashers are known from the following documents: U.S. Pat. Nos. 3,807,420; 4,179,821; EP 0 978 250 A 2, EP 0 711 528 A1, EP 0 378 836 A1 and DE 40 29 958 A1.

Industrial dishwashers which are designed for loading batches of wash ware into, and unloading the same from, a treatment chamber are available, in particular, in the form of front-loader dishwashers or hood-type dishwashers. In the case of front-loader dishwashers, the wash ware is placed in a rack and the rack loaded with wash ware is positioned in the treatment chamber through a front door and, following washing, removed through the front door again. In the case of hood-type dishwashers, the racks loaded with wash ware are pushed manually into the treatment chamber from an entry side and, following completion of a dishwashing program, removed manually from the treatment chamber from an exit side. Front-loader dishwashers and hood-type dishwashers contain just a single treatment chamber for the treatment of the wash ware. The front-loader dishwashers may be under-counter dishwashers or counter-top dishwashers.

Wash ware is usually washed by at least one washing process, during which the wash ware is sprayed with a wash liquid, and at least one subsequent final rinse process, during which the wash ware is sprayed with final rinse liquid. The final rinse liquid may be clean water or a mixture of clean water and rinse aid. Industrial dishwashers which are designed for batch loading are also referred to as batch dishwashers.

Wash ware may be, in particular, crockery, glassware, cutlery, dishes, pots, trays, boxes, etc.

Mainly two drying methods are used in industrial dishwashers. In the first method, the wash ware, still hot following the final rinse process, is removed from the machine, where it then dries in the ambient air within four to ten minutes. In order for the wash ware to dry, in the method described above, it is usually left in the racks in which it has been arranged for washing purposes in the dishwasher. In the second method, air drying takes place in the dishwasher.

Fresh-air drying systems for industrial front-loader or under-counter dishwashers operate with a high volume flow of air in the region of 25 to 60 $m^3$ per hour, in order for it to be possible to dry the crockery in a very short period of time. The high volume flows of air are necessitated by the brevity of the drying operation in the industrial sector. In comparison with conventional drying in a domestic dishwasher, the active drying time of an industrial dishwasher is many times shorter. Whereas the drying-program time in a domestic dishwasher is approximately 30 minutes to 2.5 hours, the drying-program time in the industrial sector is between 1.5 and 5 minutes. As a result of this much shorter drying operation, in particular as a result of the high volume flow of air, the condensation located in the drying channel is blown out through a blowing-out opening. In addition, relatively small quantities of wash and final rinse liquid may pass into the drying channel since the drying channel is connected to the interior of the dishwasher. In standby phases and when the machine is first started up or heated up each day, it is likewise possible for droplets of condensation to form in the drying channel.

If the drying operation is then started, the high air speeds cause the droplets of water which are located, or suspended, in the drying channel to be carried along and conveyed or blown out of the blowing-out opening of the dishwasher. Furthermore, as a result of the air flow, a film of water forming on the base of the drying channel is also discharged, in part, through the blowing-out opening. This results, on the one hand, in individual droplets being slung out of the dishwasher into the surroundings and, on the other hand, in dripping water running out of the outlet on the front side of the machine. The total quantity of water discharged in this way, the quantity varying depending on the mode of operation or cycle sequence, may be up to approximately 10 ml during a single drying phase.

It would be desirable to make it possible to reduce the discharge of water from an industrial dishwasher. It would be desirable to reduce the quantity of water passing out, in particular during the drying operation (drying phase) as the dishwasher program is running.

SUMMARY

In one aspect, a method of operating an industrial dishwasher involves the use of a primary blower that directs air from the treatment chamber through a drying channel and a secondary blower that directs ambient air from outside the dishwasher through the drying channel. During at least one phase of the operation, the secondary blower is on while the primary blower is off.

In another aspect, the method also provides that the blowers will only be switched on when the dishwasher door is not opened.

DETAILED DESCRIPTION

Figure 1:
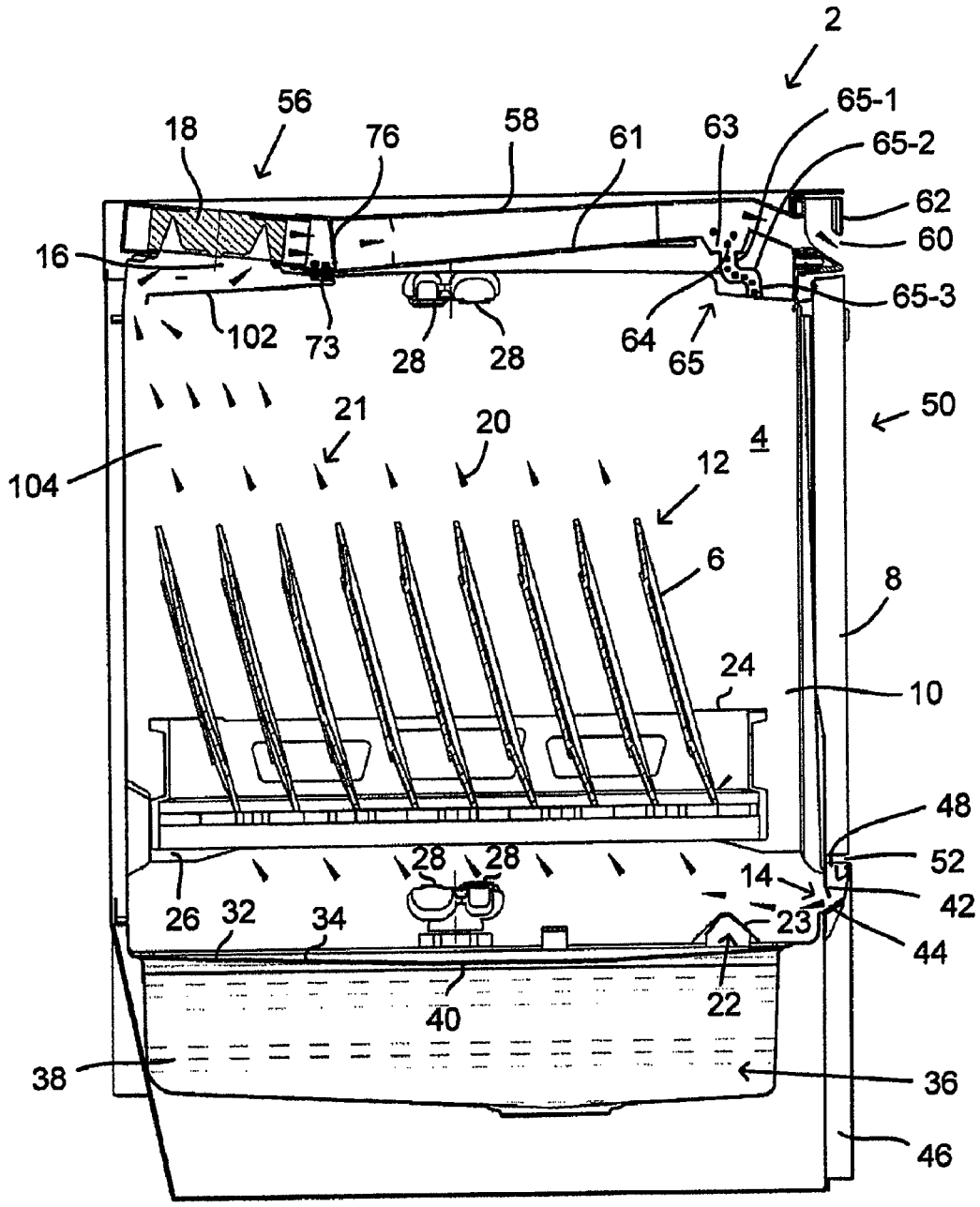
FIG. 1 shows a lateral sectional view of a first embodiment according to the invention of an industrial dishwasher.
Figure 3:
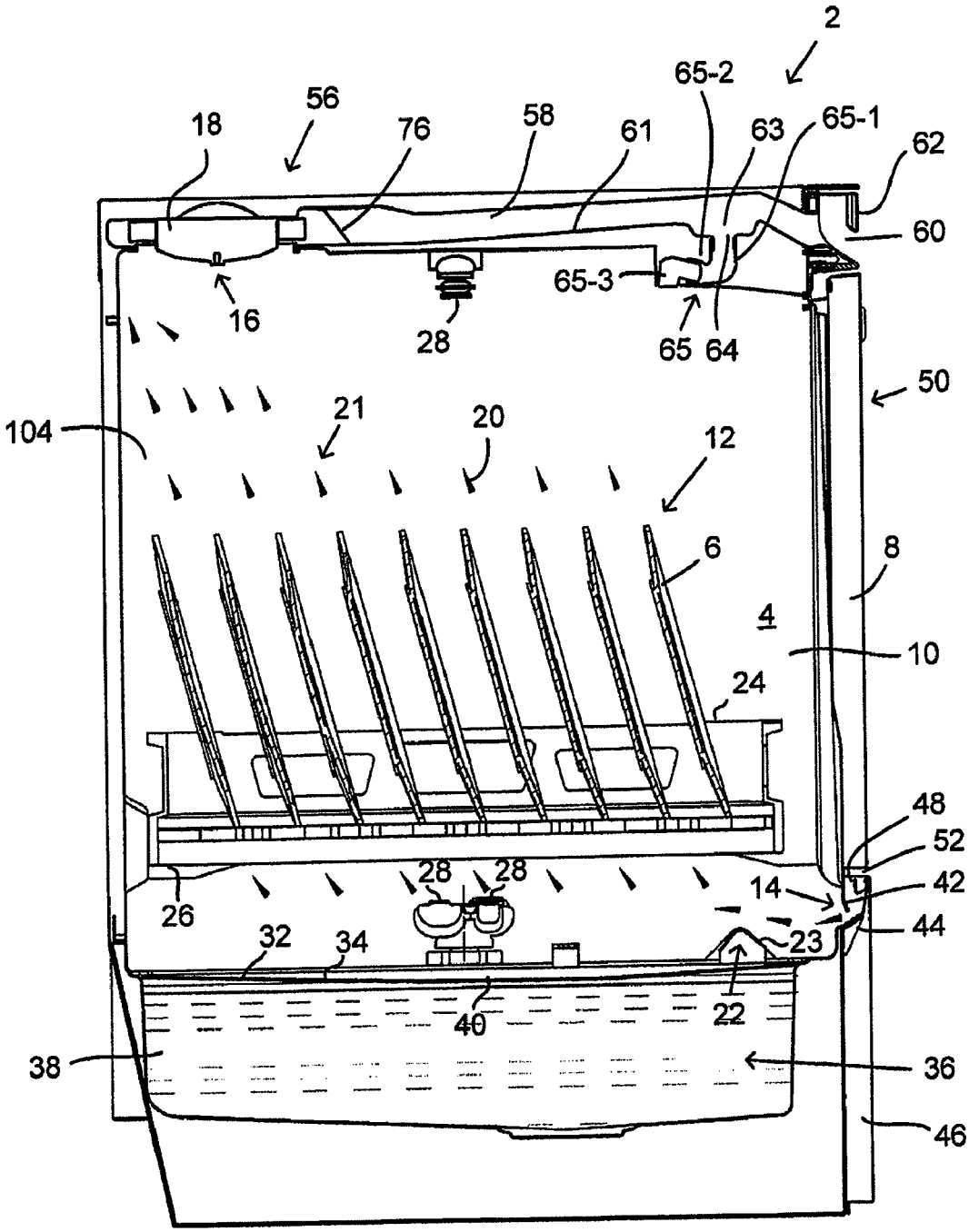
FIG. 3 shows a lateral sectional view of a second embodiment of an industrial dishwasher according to the invention.
Figure 4:
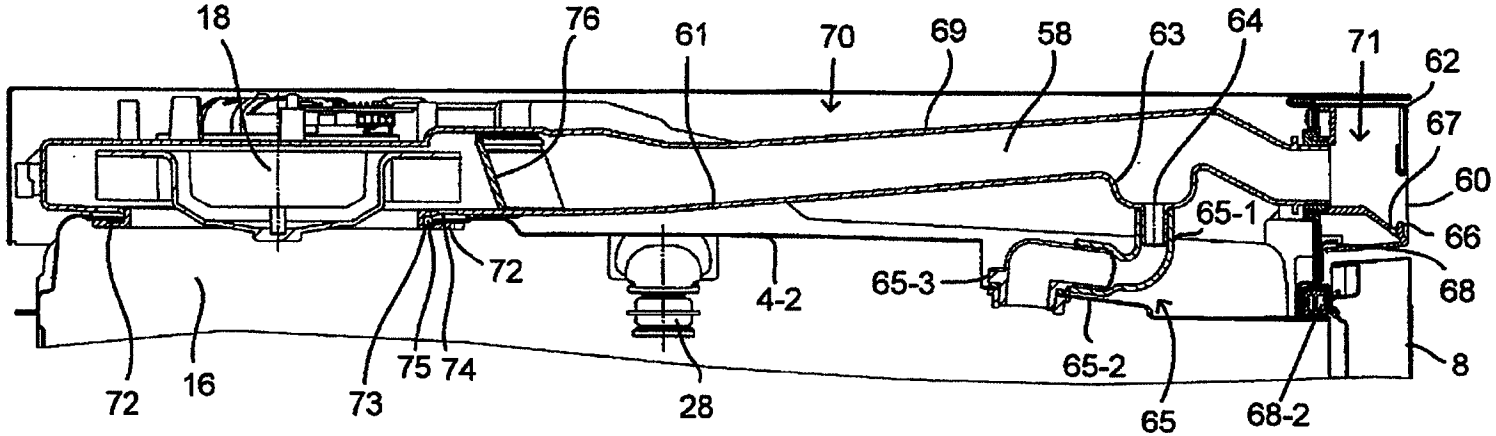
FIG. 4 shows a sectional view of part of the second embodiment.
Figure 5:
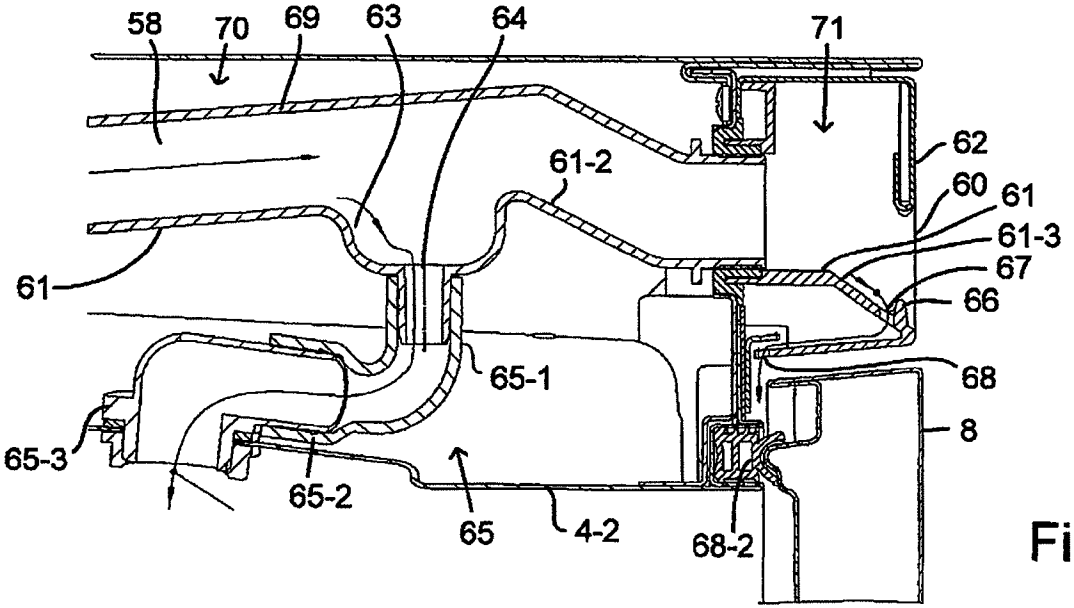
FIG. 5 shows a further sectional view of part of the second embodiment of the dishwasher according to the invention.

FIGS. 1 and 3 show a longitudinal section through an industrial dishwasher 2 having a treatment chamber 4 for accommodating wash ware 6 and a door 8 for closing a loading and unloading opening 10. The dishwasher 2 is designed for loading batches of the wash ware 6 into, and unloading the same from, a treatment region 12 in the treatment chamber 4. An air inlet 14 into the treatment chamber 4 is arranged beneath the door 8, at a lower level than the treatment region 12. An air outlet 16 out of the treatment chamber 4 is arranged at a higher level than the air inlet 14 and the treatment region 12. The dishwasher 2 has a main blower 18 for generating an airflow 20 along an air path 21, the air path 21 extending from the air inlet 14, through the treatment chamber 4, to the air outlet 16. The airflow 20 in the treatment chamber 4 is channelled through the treatment region 12 in order to dry the wash ware 6. A deflector device 22 with at least one deflector 23 is provided and designed for the purpose of acting on the airflow 20 passing into the treatment chamber 4 through the air inlet 14, and it causes the airflow to pass into the treatment region 12 from beneath in a uniformly distributed manner.

The treatment chamber 4 has, for example, a volume of between 60 l and 280 l.

The term "wash ware" 6 covers, in particular, crockery, glassware, cutlery, pots, containers, boxes, trays, etc.

The treatment region 12 is a region in the treatment chamber 4 in which the wash ware 6 is positioned in order to be washed. The wash ware 6 here is preferably arranged in a rack 24. The treatment chamber 4 may contain one or more rack mounts, for example, as illustrated, a single rack mount 26, on which a respective rack 24 can be, or has been, positioned. As an alternative, it is possible to arrange, for example, two rack mounts one above the other.

The treatment chamber 4 contains a multiplicity of spray nozzles 28 to spray liquid 38, for example wash liquid or final rinse liquid, onto the wash ware 6. Separate spray nozzles 28 may be provided in each case for spraying wash liquid and final rinse liquid. The spray nozzles 28 may be formed in particular, as illustrated, on rotatable spray tubes, on stationary spray tubes or in a treatment-chamber wall. In the case of the embodiments illustrated, the loading and unloading opening 10 is arranged on the front side 50 of the treatment chamber 4. A treatment-chamber base 32 has a through-opening 34 into a tank 36 or into a reservoir, which is provided for accommodating liquid 38. The through-opening 34 in the treatment-chamber base 32 is preferably covered by a tank screen 40. The dishwasher 2 is set up preferably for at least partially reusing the liquid 38 in the tank 36 for a further dishwashing program, i.e. for a new batch of wash ware 6.

The operating temperature of the liquid 38 in the tank 36 is preferably between 55° C. and 65° C. and is kept at the operating temperature by a suitable temperature-control device. It is possible to provide a temperature-control device for a final rinse liquid (not illustrated), for example outside the treatment chamber 4, which keeps the temperature of the final rinse liquid preferably between 63° C. and 85° C.

According to the embodiments which are illustrated in FIGS. 1 and 3, the air inlet 14 is formed between directing elements 42, 44 which are connected to a machine housing 46 or are formed by the same. A top directing element 42 and a bottom directing element 44 here form at least one gap or slot. The bottom directing element 44 is preferably inclined downwards in the direction of the treatment chamber 4. The top directing element 42 is preferably inclined away from the treatment chamber 4.

The air inlet 14 is preferably designed for generating an airflow 20 which covers the entire width of the treatment region 12.

An air-inlet path 48 extends from a front side 50 of the dishwasher 2, through the bottom door gap 52 to the air inlet 14. As an alternative, the air-inlet path 48 can extend from an opening in a housing part, or from an opening in the door 8, to the air inlet 14. The air-inlet path 48 is preferably labyrinthine (cf. FIGS. 1 and 3), in order to avoid the situation where wash liquid 38, during a spraying operation of the spray nozzles 28, passes out of the dishwasher 2 through the air-inlet path 48. A particle filter, for example a dust filter, may be arranged in the air-inlet path 48.

The deflector device 22, which is arranged in the air path 21 of the airflow 20, may be formed in one piece. As an alternative, the deflector device 22 may be formed in more than one piece, with at least two deflectors 23. The at least two deflectors 23 may be spaced apart from one another.

In the case of those embodiments of the dishwasher 2 according to the invention which are illustrated in FIGS. 1 and 3, the deflector device 22 is spaced apart from the air inlet 14. In particular, the deflector device 22 may be arranged on the treatment-chamber base 32. As an alternative, the deflector device 22, or at least one deflector 23 thereof, may be arranged on the tank screen 40. The deflector device 22 may alternatively be arranged adjacent to the air inlet 14, for example on a treatment-chamber wall.

The air outlet 16 is arranged in a top rear region 56 of the treatment chamber 4. The air path 21, and thus also the airflow 20, thus extends throughout the treatment region 12 of the treatment chamber 4, a good drying result thus being achieved. As an alternative, the air outlet 16 may be arranged at some other location above the wash-ware region 12.

Downstream of the air outlet 16, as seen in the flow direction, a drying channel 58 extends from the air outlet 16 to a machine outlet in the form of a blowing-out opening 60, which is preferably arranged on the front side 50 of the machine, as is illustrated, for example, in FIGS. 1 to 4. The drying channel 58 preferably extends above the treatment chamber 4 and beneath a dishwasher top. An outlet covering 62, which is arranged in the region of the blowing-out opening 60, ensures the desired flow conditions at the blowing-out opening 60.

In its base 61, the drying channel 58 has a drainage means 63 running transversely to the channel base 61. The drainage means 63 has a drainage opening 64. The channel base 61 slopes up from the air outlet 16 in the direction of the drainage means 63. The drainage opening 64 of the drainage means 63 is protected on its underside against splash water from the treatment chamber 4 by a splash screen. In the embodiments described, the splash screen comprises a tubular drainage channel 65 having (cf., in this respect, also FIG. 4 in particular) a downwardly directed drainage portion 65-1 adjacent to the drainage opening 64, having an intermediate portion 65-2 which adjoins the drainage portion 65-1 and runs transversely thereto, i.e. runs approximately horizontally, and having an end portion 65-3 which adjoins the intermediate portion 65-2, is, in turn, directed downwards and has an approximately downwardly directed opening. The splash screen or the drainage channel 65 may be oriented (cf. FIG. 1) in the direction of the front side of the dishwasher 2 or else of the rear side thereof (cf. FIG. 3). A lateral orientation is also conceivable.

The drainage means 63 is arranged closer to the blowing-out opening 60 than to the air outlet 16. In the case of the preferred embodiments described, the drainage means 63 is arranged in that half of the drying channel 58 which is directed towards the blowing-out opening 60, preferably in the region of approximately 60% to 95% of the drying-channel length, further preferably in the region of 75% to 85% of the length thereof.

In the bottom region of the blowing-out opening 60 (cf. FIG. 4), an outflow barrier 66 is formed by a protrusion which extends upwards from the channel base 61 of the blowing-out opening 60. This barrier prevents wash liquid or condensation which reaches the outflow barrier 66 from passing out onto a floor or onto the door 8. Upstream of the outflow barrier 66, in the region of the same or in front of the same, a second drainage opening 67 is formed in the base of the drying channel 58. Liquid which is prevented from passing out of the dishwasher 2 by the outflow barrier 66 can run out through the second drainage opening 67. The second drainage opening 67 opens out into a removal channel 68. The removal channel 68 terminates behind the top end of the door 8 of the dishwasher 2, above a door seal 68-2 serving as a sealing element between the door 8 and the housing of the dishwasher 2.

Downstream of the drainage means 63, i.e. between the drainage means 63 and the blowing-out opening 60, the channel base 61 slopes down, at least in part, in the direction of the blowing-out opening 60. In the embodiments according to FIGS. 1 and 3, a portion 61-2 of the channel base 61 slopes down directly downstream of the drainage means 63. A further downwardly sloping channel-base portion 61-3 is arranged upstream of the outflow barrier 66 and terminates at the outflow barrier 66.

The drying channel 58 has a channel body 69. This forms a first drying-channel portion 70, which extends from the air outlet 16 into the vicinity of the front edge of the dishwasher 2. The first drying-channel portion 70 is adjoined by a second drying-channel portion 71, which opens out into the blowing-out opening 60. The channel body 69 and the main blower 18 are fastened on the top 4-2 of the treatment chamber 4 by a fastening element, e.g. in the form of a bayonet nut 72. A condensation outflow 73 from the drying channel 58 into the treatment chamber 4 is provided in the region of the rear end of the drying channel 58, i.e. on that side of the same which is directed towards the air outlet 16 of the treatment chamber 4, and at the lowermost point of the drying channel 58. The condensation outflow 73 can open out into the air outlet 16 of the treatment chamber 4, or it opens out into the treatment chamber 4 through apertures 74 in the channel body 69 and corresponding apertures 75 in the fastening element, which, as already mentioned, in the preferred embodiment illustrated is the bayonet nut 72.

In the embodiments illustrated, the main blower 18 is arranged in a region between the air outlet 16 and blowing-out opening 60 for the purpose of sucking air out of the treatment chamber 4. The main blower 18 is preferably arranged at the air outlet 16. As an alternative to the embodiments illustrated, the main blower may be set up for blowing air into the treatment chamber 4.

In particular, provision may be made, as is illustrated in FIG. 1, for a helical housing of the main blower 18 to be inclined in the direction of the condensation outflow 73, so that liquid in the main blower 18 runs out in the direction of the condensation outflow 73. As an alternative, it is also possible for the helical housing of the main blower 18 to be arranged horizontally.

The drying channel 58 preferably contains a closure element 76, as is illustrated in FIGS. 1 and 3, for the purpose of closing the drying channel 58 when the main blower 18 is switched off. The closure element 76, in particular, prevents a spray mist from moving out of the dishwasher 2, through the drying channel 58 and the blowing-out opening 60, during operation of the spray nozzles 28. The closure element 76 may be a controllable closure element controlled by a control means (not illustrated). However, the closure element 76 is preferably formed, as illustrated, by a flap which is automatically opened by the airflow 20 generated by the main blower 18 and is automatically closed when the main blower 18 is switched off. For this purpose, the flap is preferably mounted at its top end, so that, when the main blower 18 is switched off, the flap is automatically closed by gravitational force.

Alongside the main blower 18, an additional blower 77 (cf. FIG. 6) is provided for the purpose of feeding ambient air 78 to the airflow 20, downstream of the main blower 18 and downstream of the air outlet 16, as seen in the flow direction of the airflow 20. The additional blower 77 is provided for feeding ambient air through an ambient-air channel 80 into the drying channel 58. In the case of the embodiment illustrated, an inlet 79 of the additional blower 77 is arranged on the top side of the additional blower 77, although it may be located at any other desired location, in accordance with the type of blower used. A mouth region 82, in which the ambient-air channel 80 opens out into the drying channel 58, acts as a mixing chamber for mixing the ambient air 78 fed through the ambient-air channel 80 and the airflow 20 from the treatment chamber 4. The ambient air is atmospheric external air which is taken in in a region between a treatment-chamber top and the dishwasher top.

Figure 6:
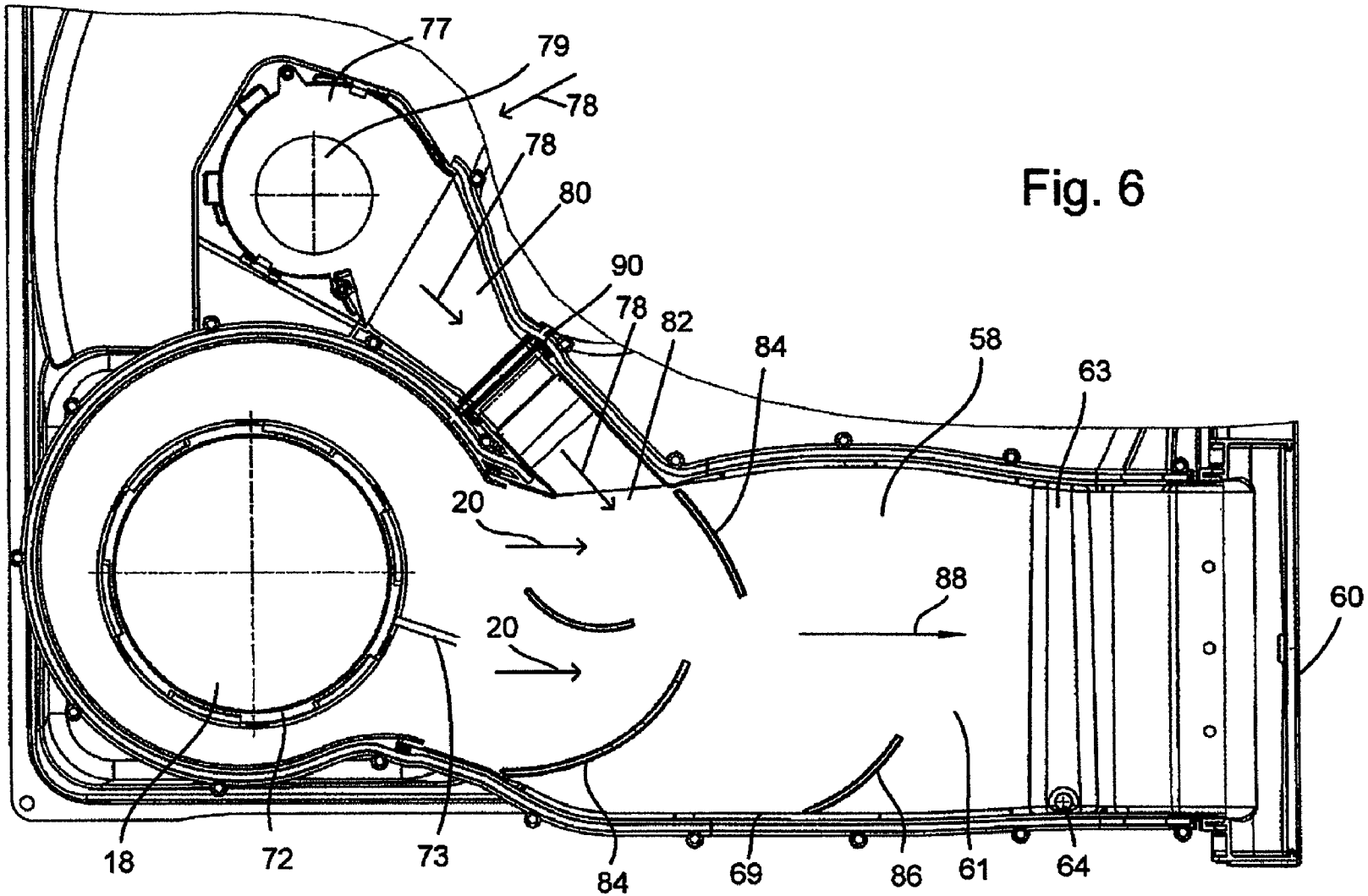
FIG. 6 shows a sectional view of part of the dishwasher according to FIGS. 1 and 3 in plan view.

As is illustrated in FIG. 6, flow-directing elements 84 may be provided in order to improve mixing of the two airflows. Flow-directing elements 86 may be provided downstream of the mouth region 82, as seen in the flow direction, in order to reduce vortexing in the resulting airflow 88. Feeding ambient air into the airflow 20 flowing out of the treatment chamber 4 reduces a condensation effect outside the dishwasher 2 which is caused by the moisture-laden air flowing out of the spray chamber 4. The ambient-air channel 80 may contain a closure element 90 for the purpose of closing the ambient-air channel 80 when the additional blower 77 is switched off. The closure element 90 of the ambient-air channel 80 may be formed, in particular, by a closure element as has been described above with reference to the drying channel 58. The course taken by the condensation outflow 73 can also be gathered clearly from FIG. 6. This condensation outflow comprises a channel which extends (radially) in the direction of the main blower 18 and then opens out into an aperture in the bayonet nut 72.

In the embodiment illustrated, the main blower 18 is designed for generating an airflow 20 at a rate corresponding to 6 times to 12 times the treatment-chamber volume per minute. Whereas the air is taken in axially out of the treatment chamber, it is blown out in the radial direction.

In the case of the embodiment which is illustrated in FIG. 1, a splash guard 102 is arranged upstream of the air outlet 16 in order to avoid or reduce instances where liquid passes out of the treatment chamber 4 through the air outlet 16. The splash guard 102 may be provided with a grease filter. In the embodiment illustrated, the splash guard 102 is arranged in relation to the condensation outflow 73 such that condensation running out through the condensation outflow 73 drips onto the splash guard 102 and is directed by the same to a peripheral region 104 of the treatment chamber 4 and thus past the wash-ware region 12. The splash guard is optional and has not been illustrated in the embodiment according to FIG. 3.

Figure 2:
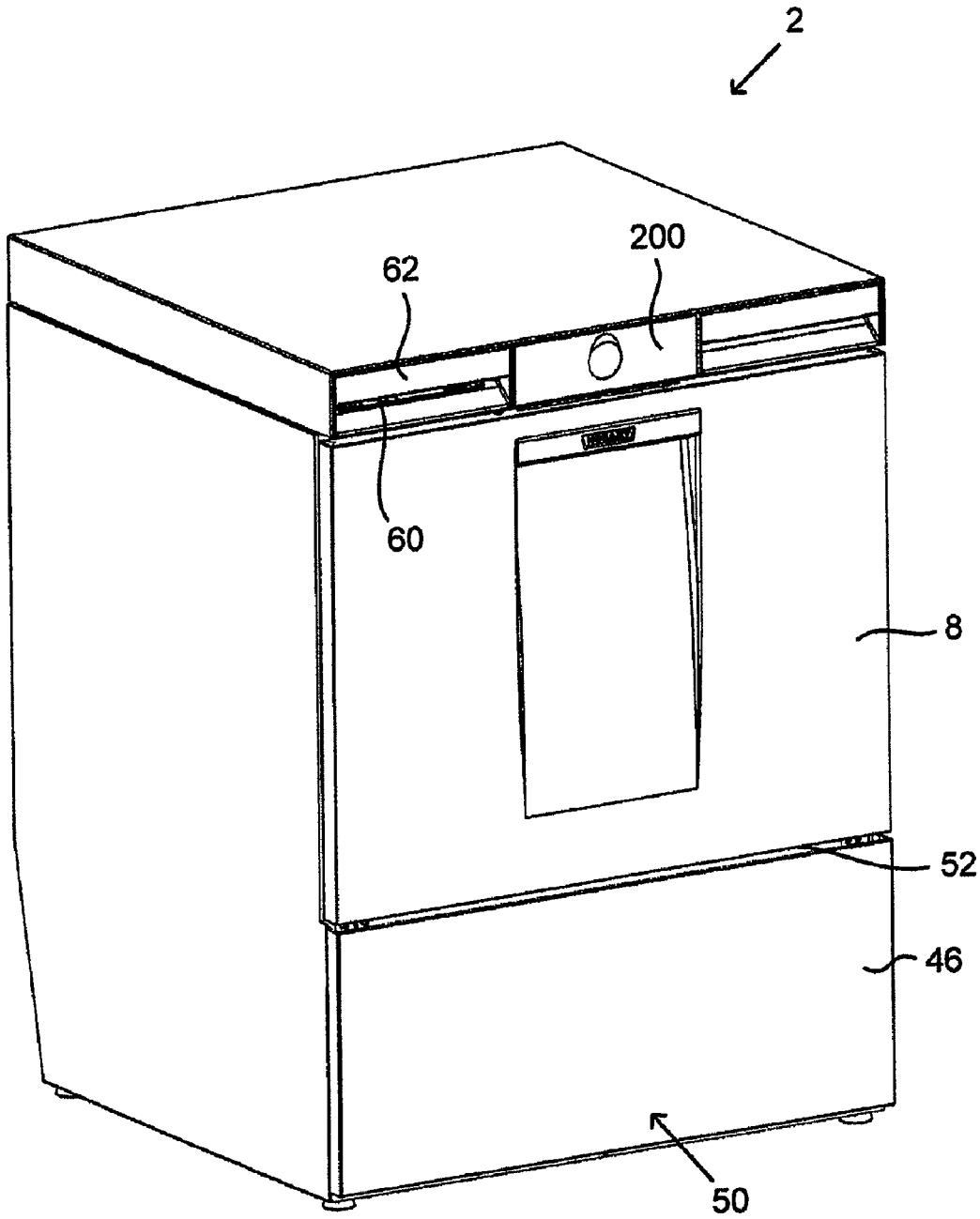
FIG. 2 shows a perspective view of the industrial dishwasher from FIG. 1.

For the program control of the dishwasher 2 and its parts, such as, in particular, the main blower 18 and the additional blower 77, a program controller 200, which is indicated schematically in FIG. 2, is provided.

The invention covers the following embodiments of methods which can be implemented in the combinations given, but also in other combinations and can also advantageously be used on their own. The invention also covers industrial dishwashers which contain a program controller 200 for automatically implementing the relevant method.

Embodiment 1

Method of operating an industrial dishwasher in the form of a batch dishwasher, in which method a washing phase, a final rinse phase and a drying phase can be implemented; wherein, during the drying phase, program control automatically provides for a main blower to blow atmospheric first ambient air through an air inlet into a treatment chamber, and over wash ware located therein, and then through an air outlet out of the treatment chamber and from the air outlet, through a drying channel, to a blowing-out opening and, through the latter, out of the dishwasher, and wherein, likewise during the drying phase, program control automatically provides for an additional blower to blow atmospheric second ambient air directly into the drying channel and, through the drying channel, to the blowing-out opening; characterized in that, during at least one operating state other than the drying phase, program control automatically provides for second ambient air to be blown by means of the additional blower directly into the drying channel and through the latter and out through the blowing-out opening, the dishwasher being switched on but the main blower being switched off.

Embodiment 2

Method as per embodiment 1, characterized in that in each case once a wash tank of the dishwasher has been filled with wash liquid, when the wash tank is filled for the first time, or is completely filled again, the additional blower is switched on, and blows second ambient air into the drying channel and through the drying channel and then out through the blowing-out opening if a door of the treatment chamber is not opened following completion of the filling operation, the main blower remaining switched off during the filling operation and also during this operation of the additional blower.

Embodiment 3

Method as per embodiment 2, characterized in that, following completion of the filling operation, the additional blower is automatically switched on only if the door of the treatment chamber has not been opened within a predetermined period of time following the filling operation.

Embodiment 4

Method as per embodiment 3, characterized in that the additional blower is automatically switched off when the door is opened.

Embodiment 5

Method as per embodiment 3, characterized in that if the additional blower has been running for a predetermined period of time, and the door is still closed, this automatically results in the start-up of a standby phase in which the additional blower is switched on for a short period of time in each case at predetermined time intervals, the standby phase lasting until such time as the door is opened or a cleaning program is started or the dishwasher is switched off, in which case the additional blower is automatically switched off definitively.

Embodiment 6

Method as per one of the preceding embodiments, characterized in that, during the drying phase, the main blower and the additional blower are switched on and blow air through the drying channel; in that if, during the drying phase, the door of the treatment chamber is opened, the main blower and the additional blower are automatically switched off and, if the door remains open, also remain switched off; in that nevertheless, if the door is closed again within a predetermined period of time, the additional blower is switched on again at least once for at least one predetermined period of time, the main blower remaining switched off.

Embodiment 7

Method as per embodiment 6, characterized in that if, following opening and reclosure, the door still remains closed, this automatically results in the start-up of a standby phase in which the additional blower is periodically switched on, and then switched off again, for a short period of time in each case at certain points in time, the main blower remaining switched off.

Embodiment 8

Method as per one of the preceding embodiments, characterized in that it is made possible to switch off the drying phase manually, so that, at the start of a cleaning program, only at least one washing phase, and then at least one final rinse phase, but no drying phase, proceed, and in that, in the case of such a cleaning program which proceeds without a drying phase, the additional blower is at least temporarily switched on during the final rinse phase in order, at least temporarily during the final rinse phase, to blow ambient air directly into the drying channel and, through the latter, to the blowing-out opening, the main blower remaining switched off.

Embodiment 9

Method as per embodiment 8, characterized in that if, following completion of the final rinse phase, the door of the treatment chamber is not opened, the additional blower is automatically switched on again, and then switched off again, for a short period of time in each case at certain time intervals until such time as the door is opened, or a new cleaning program is started or the dishwasher is switched off.

Embodiment 10

Method as per embodiment 8 or 9, characterized in that if, following completion of the final rinse phase, the door is opened and, following opening and reclosure, still remains closed, this automatically results in the start-up of a standby phase in which the additional blower is periodically switched on, and then switched off again, for a short period of time in each case at certain points in time, the main blower remaining switched off.

The invention claimed is:

1. A method of operating an industrial dishwasher in the form of a batch dishwasher in which a washing phase, a final rinse phase and a drying phase can be implemented;

wherein, during the drying phase, program control automatically provides for a main blower to blow atmospheric first ambient air through an air inlet into a treatment chamber, and over wash ware located therein, and then through an air outlet out of the treatment chamber and from the air outlet, through a drying channel, to a blowing-out opening out of the dishwasher, and wherein, during the drying phase, program control automatically provides for an additional blower to blow atmospheric second ambient air directly into the drying channel and, through the drying channel, to the blowing-out opening;

and wherein, during at least one operating state other than the drying phase, program control automatically provides for second ambient air to be blown by the additional blower directly into the drying channel and through the drying channel and out through the blowing-out opening, while the dishwasher is switched on but the main blower is switched off, and wherein when a wash tank of the dishwasher has been filled with wash liquid, either filled for the first time or subsequently filled again, the additional blower is switched on, and blows second ambient air into the drying channel and through the drying channel and then out through the blowing-out opening, provided a door of the treatment chamber is not opened following completion of the filling operation, where the main blower remains switched off both during the filling operation and during operation of the additional blower.

2. The method of claim 1 wherein following completion of the filling operation, the additional blower is automatically switched on only if the door of the treatment chamber has not been opened within a predetermined period of time following the filling operation.

3. The method of claim 2 wherein the additional blower is automatically switched off when the door is opened.

4. The method of claim 2 wherein when the additional blower has been running for a predetermined period of time, and the door is still closed, a standby phase is automatically initiated in which the additional blower is switched on for a period of time at predetermined time intervals, wherein the standby phase is terminated when the door is opened or a cleaning program is started or the dishwasher is switched off, resulting in the additional blower being automatically switched off.

5. A method of operating an industrial dishwasher in the form of a batch dishwasher in which a washing phase, a final rinse phase and a drying phase can be implemented;

wherein, during the drying phase, program control automatically provides for a main blower to blow atmospheric first ambient air through an air inlet into a treatment chamber, and over wash ware located therein, and then through an air outlet out of the treatment chamber and from the air outlet, through a drying channel, to a blowing-out opening out of the dishwasher, and wherein, during the drying phase, program control automatically provides for an additional blower to blow atmospheric second ambient air directly into the drying channel and, through the drying channel, to the blowing-out opening;

and wherein during at least one operating state other than the drying phase, program control automatically provides for second ambient air to be blown by the additional blower directly into the drying channel and through the drying channel and out through the blowing-out opening, while the dishwasher is switched on and the main blower is switched off, and wherein during the drying phase, the main blower and the additional blower are switched on and blow air through the drying channel; and wherein upon opening of the door of the treatment chamber during the drying phase, the main blower and the additional blower are automatically switched off and remain off while the door remains open, and wherein reclosing the door within a predetermined period of time, switches the additional blower on again at least once for at least one predetermined period of time, while the main blower remains switched off.

6. The method of claim 5 wherein following opening and reclosure of the door of the treatment chamber, if the door remains closed, a standby phase is automatically initiated in which the additional blower is periodically switched on, and then switched off again, for a period of time at certain points in time, while the main blower remains switched off.

7. A method of operating an industrial dishwasher in the form of a batch dishwasher in which a washing phase, a final rinse phase and a drying phase can be implemented;

wherein, during the drying phase, program control automatically provides for a main blower to blow atmospheric first ambient air through an air inlet into a treatment chamber, and over wash ware located therein, and then through an air outlet out of the treatment chamber and from the air outlet, through a drying channel, to a blowing-out opening out of the dishwasher, and wherein, during the drying phase, program control automatically provides for an additional blower to blow atmospheric second ambient air directly into the drying channel and, through the drying channel, to the blowing-out opening;

and wherein, during at least one operating state other than the drying phase, program control automatically provides for second ambient air to be blown by the additional blower directly into the drying channel and through the drying channel and out through the blowing-out opening, while the dishwasher is switched on but the main blower is switched off, and wherein, the drying phase can be manually switched off, thus providing a cleaning program comprising only at least one washing phase, and then at least one final rinse phase, without a drying phase, wherein the additional blower is at least temporarily switched on during the final rinse phase in order, to blow ambient air directly into the drying channel and through the drying channel to the blowing-out opening, while the main blower remains switched off.

8. The method of claim 7 wherein following completion of the final rinse phase, with the door of the treatment chamber closed, the additional blower is automatically switched on again, and then switched off again, for a period of time at certain time intervals until the door is opened, or a new cleaning program is started or the dishwasher is switched off.

9. The method of claim 7 wherein following completion of the final rinse phase and, following opening and reclosure of the door of the treatment chamber, if the door remains closed, a standby phase is automatically initiated in which the additional blower is periodically switched on, and then switched off again, for a period of time at certain points in time, while the main blower remains switched off.

* * * * *

UNITED STATES PATENT AND TRADEMARK OFFICE

CERTIFICATE OF CORRECTION

PATENT NO. : 7,875,122 B2
APPLICATION NO. : 12/032754
DATED : January 25, 2011
INVENTOR(S) : Gonska et al.

It is certified that error appears in the above-identified patent and that said Letters Patent is hereby corrected as shown below:

Claim 7, Col. 10, Line 43

After "the final rinse phase in order" remove --,--

Signed and Sealed this
Thirty-first Day of May, 2011

David J. Kappos

David J. Kappos
*Director of the United States Patent and Trademark Office*